US005337418A

United States Patent [19]

Kato et al.

[11] Patent Number: 5,337,418

[45] Date of Patent: Aug. 16, 1994

[54] PROTECTOR AND ARTICLE OF SPORTSWEAR USING THE SAME

[75] Inventors: Koji Kato, Tokyo; Reiji Oshima, Ichikawa, both of Japan

[73] Assignee: K & K Inc., Tokyo, Japan

[21] Appl. No.: 64,338

[22] Filed: May 19, 1993

Related U.S. Application Data

[63] Continuation of Ser. No. 744,670, Aug. 9, 1991, abandoned, which is a continuation of Ser. No. 376,115, Jul. 6, 1989, abandoned.

[30] Foreign Application Priority Data

Jul. 8, 1988 [JP] Japan ..... 63-170085
Jul. 8, 1988 [JP] Japan ..... 63-170086

[51] Int. Cl.[5] ..... A41D 13/00
[52] U.S. Cl. ..... 2/2; 2/44
[58] Field of Search ..... 2/2, 2.5, 2.1 A, 2.1 R, 2/23, 24, 44, 79, 84, 92, 94, 102, 108, DIG. 3

[56] References Cited

U.S. PATENT DOCUMENTS 1,659,100 2/1928 Hardage ..... 2/23
3,083,373 4/1967 Rizzoto ..... 2/3 X
3,411,157 11/1968 Robenhorst ..... 2/2.1 R
3,564,611 2/1971 Hardy et al. ..... 2/2.1 A
3,945,042 3/1976 Lobo ..... 2/2
4,370,754 2/1983 Donzis ..... 2/DIG. 3 X
4,538,301 9/1985 Sawatzki ..... 2/2
4,547,917 10/1985 Wang ..... 2/DIG. 3
4,688,269 8/1987 Maeshima ..... 2/2
4,700,407 10/1987 Mattila ..... 2/2 X
4,810,559 3/1989 Fortier ..... 2/2 X
4,982,447 1/1991 Henson ..... 2/2
5,034,998 7/1991 Kolsky ..... 2/2

FOREIGN PATENT DOCUMENTS 3409323 9/1985 Fed. Rep. of Germany ..... 2/2
2154124 3/1984 United Kingdom ..... 2/24
2177892 4/1986 United Kingdom ..... 2/2

*Primary Examiner*—Daniel P. Stodola
*Assistant Examiner*—John P. Darling

[57] ABSTRACT

Protector and an article of sportswear using the same. The protector includes a cushioning pad for buffering external impact, the cushioning pad having one face being adapted to be mounted over a garment, and a plurality of parallel protecting rigid members, mounted on the other face of the cushioning pad in a spaced manner, for protecting the cushioning pad from being damaged from the external impact.

2 Claims, 7 Drawing Sheets

PROTECTOR AND ARTICLE OF SPORTSWEAR USING THE SAME

This is a continuation of copending application(s) Ser. No. 07/744,670 filed on Aug. 9, 1991 (now abandoned) which is a continuation of application Ser. No.: 07,376,115 filed Jul. 6, 1989 (now abandoned).

BACKGROUND OF THE INVENTION

1. Field of the Invention

The present invention relates to a protector and an article of sportswear using the same and more particularly but not exclusively relates to a protecting pad which is adapted to be mounted to an article of sportswear and an article of sportswear having such a protecting pad attached thereto.

2. Prior Art

Usually, protectors are put on bodies of athletes in various hard sports, such as skiing, baseball and motorcycling, for effectively protecting them from unexpected impact. Conventional protectors include, for example, a one-piece synthetic resin protector, a protector pad, inserted in pants cloth, such as a knee pad of ski pants, an inner protector, such as used by baseball umpires, and a shinguard used by a catcher.

However, conventional protectors are disadvantageous in that provision of flexibility to them for fully following various movements of a body of the wearer rather deteriorates rigidity thereof. The rigidity or hardness of the protectors is required for protecting the wearer against damages due to external excessive impact. Thus, conventional protectors do not fully meet these conflicting requirements. The prior art covers protectors over an article of sportswear and fails to provide an integral type of protecting garment, in which protectors and the garment are integrally formed, except ski pants having knee pads of a flexible plastic plate incorporated into them. The knee pads of the ski pants are poor in rigidity for fitting the body of the wearer and hence they are not sufficient as protectors for hard sports.

Accordingly, it is an object of the present invention to provide a protector and an article of sportswear using the protector. The protector has sufficient rigidity against damage from external impact with light weight as compared to the prior art protector whereas it has sufficient flexibility to follow movements of the body of the wearer, thus fitting the latter.

SUMMARY OF THE INVENTION

With this and other objects in view, one aspect of the present invention is directed to a protector including a cushioning pad for buffering external impact, the cushioning pad having one face being adapted to be mounted over a garment, and a plurality of parallel protecting rigid members, mounted on the other face of the cushioning pad in a spaced manner, for protecting the cushioning pad from being damaged from the external impact.

Another aspect of the present invention is directed to an article of sportswear having the protector above defined mounted thereon.

DETAILED DESCRIPTION OF THE PREFERRED EMBODIMENTS

Figure 1:
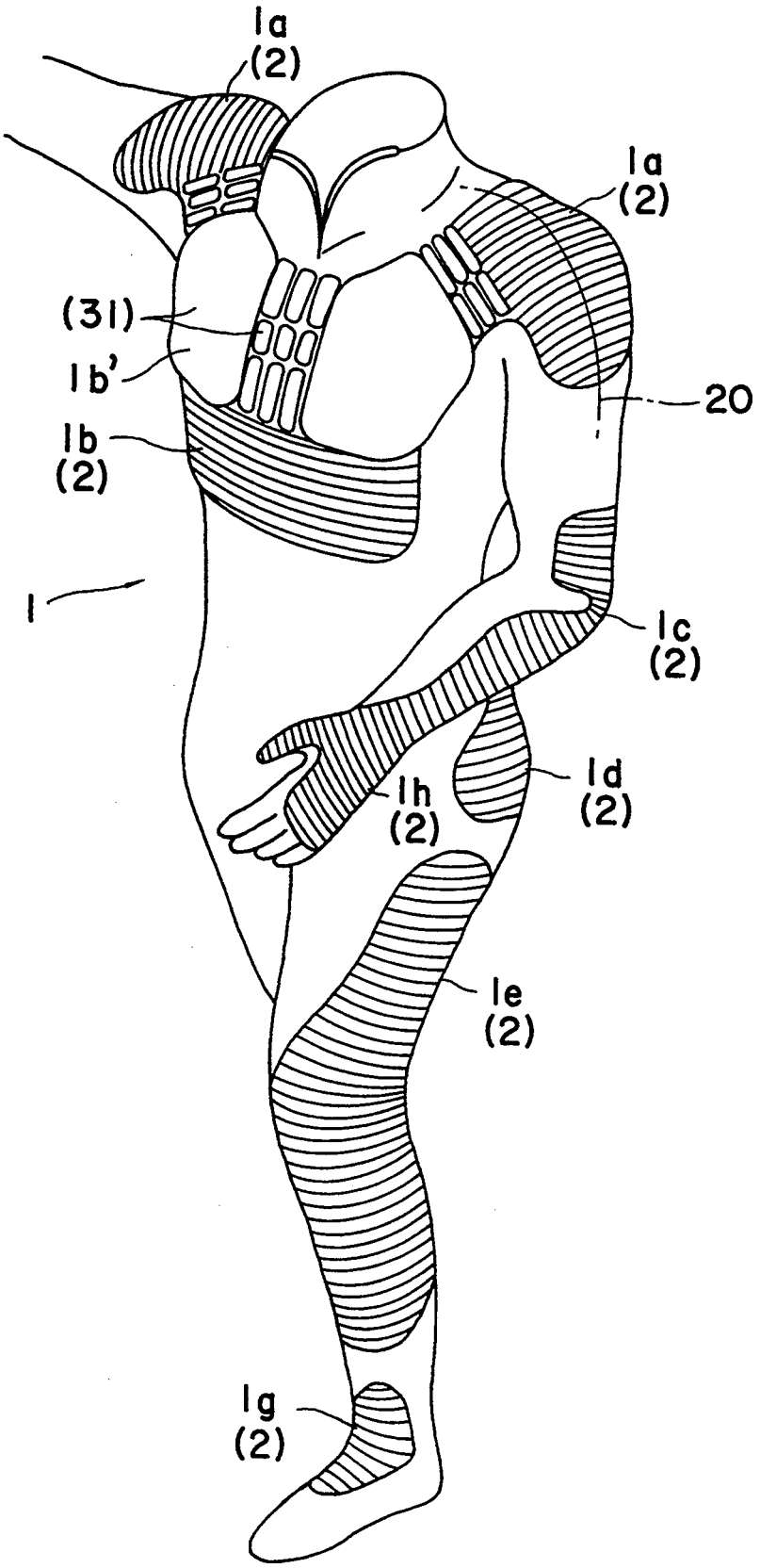
FIG. 1 is a perspective view of an article of sportswear having protecting pad according to the present invention.
Figure 2:
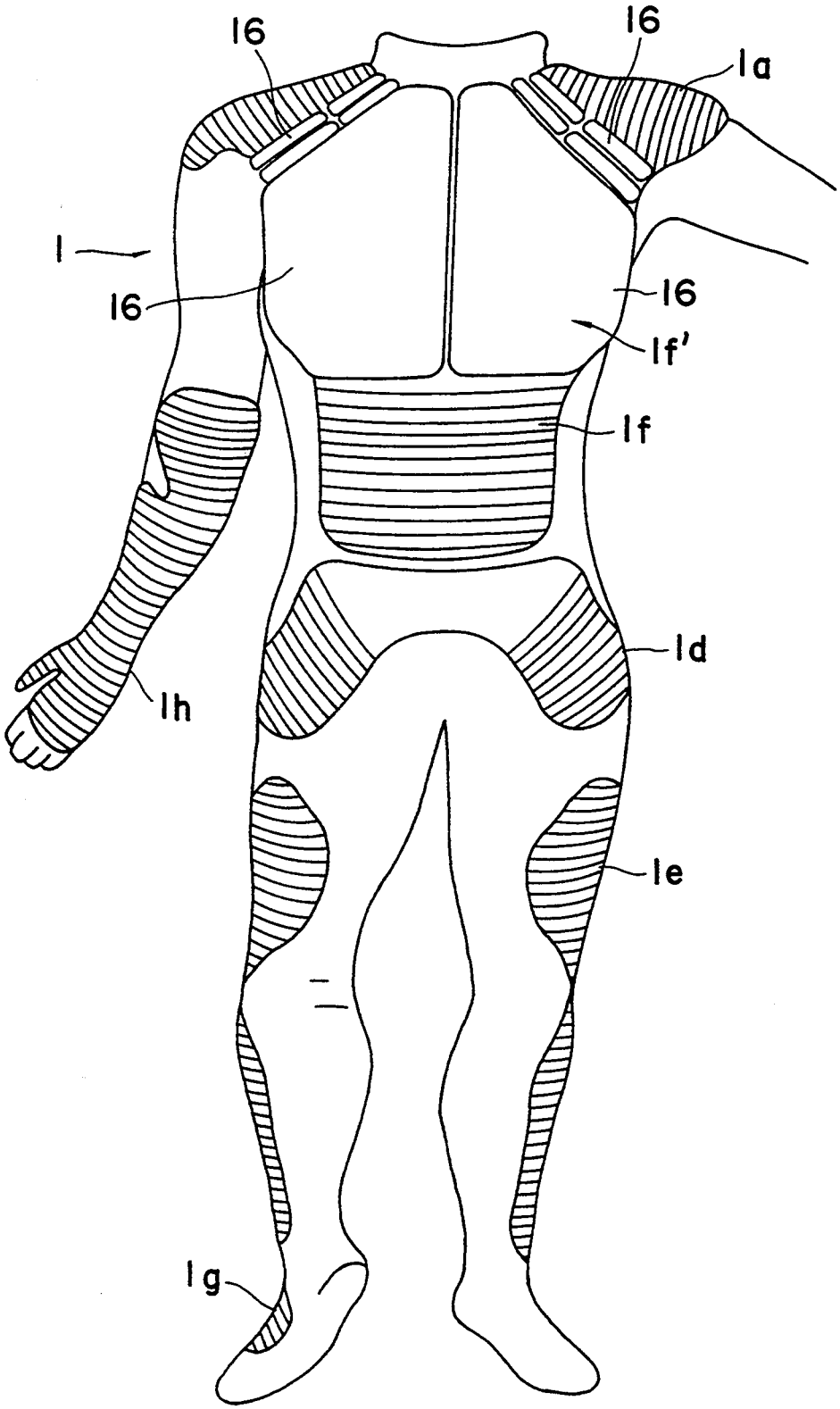
FIG. 2 is a rear view of the article in FIG. 1.
Figure 3:
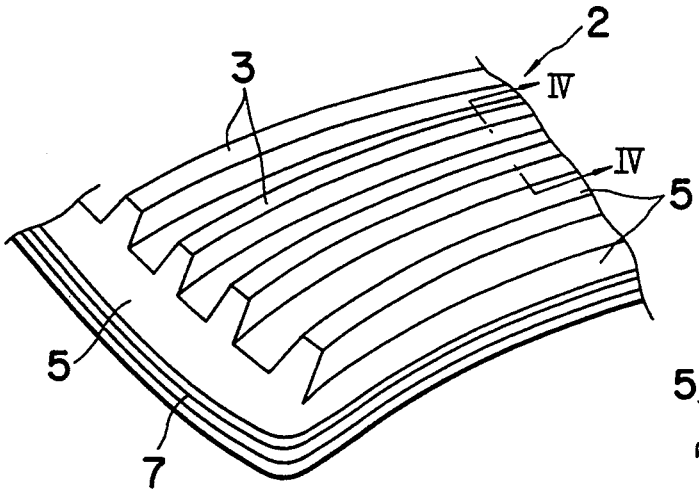
FIG. 3 is an enlarged fragmentary perspective view of each protecting pad in FIG. 1.
Figure 4:
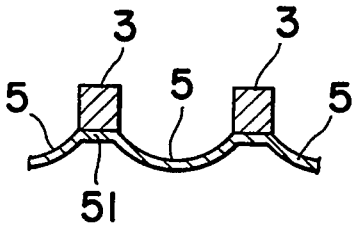
FIG. 4 is a view taken along the line IV—IV in FIG. 3.
Figure 5:
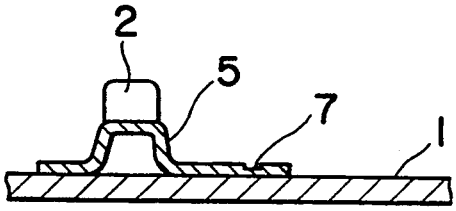
FIG. 5 is a cross-section of a peripheral portion of the protecting pad in FIG. 3.
Figure 6:
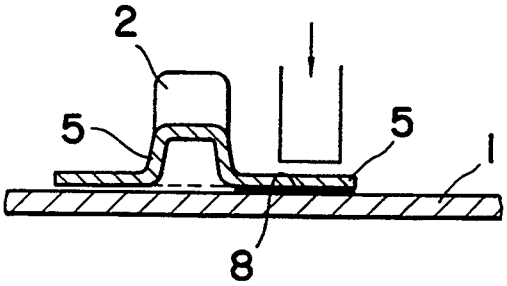
FIG. 6 is an illustration as to how to bond the cushioning sheet to the article of the sportswear.

Referring to the drawings, like reference characters designate corresponding parts throughout views and description thereof is omitted after once given. Referring to FIGS. 1 and 2, the reference numeral 1 indicates an article of skiwear for contests. The garment 1 has a plurality of protectors or protecting pads 2 jointed on its shoulders 1*a*, 1*a*, chest 1*b*, elbows 1*c*, 1*c*, waist 1*d*, legs 1*e*, 1*e*, back 1*f* and front portions of ankles 1*g*, 1*g* and wrists 1*h*, 1*h*, and the protecting pads 2 are mounted to optimum positions of the garment according to the kind of sport. As illustrated in FIGS. 3 and 4, each protecting pad 2 includes a cushioning sheet 5 for resiliently cushioning external impact applied to it, and a plurality of rigid ribs 3 jointed to the upper face of the cushioning sheet 5 to be substantially parallel to each other with equal intervals. In this embodiment, the cushioning sheet 5 is corrugated, and rigid ribs 3 are bonded to respective tops 51 of the sheet 5 as shown in FIG. 4. The cushioning sheet 5 and the rigid ribs 3 may be integrally jointed by heating them. Preferably, the rigid ribs 3 are made of a rigid vinyl chloride resin. The cushioning sheet 5 is preferably made of a soft vinyl chloride resin, ABS resin, urethane resin, nylon resin, and silicon resin. The protecting pads 2 thus prepared may be sewn to respective parts of the garment 1 by a sewing machine or may be attached to them through adhesive tapes. The parts 1*a*–1*h* the garment 1 are selected according to the kind of the sportswear. It is preferable to attach protecting pads 2 to the garment 1 at portions where external impact is liable to be applied and where bending and stretching thereof occur frequently in use. The protecting pads 2 are attached to the garment 1 so that each rigid rib 3 extends transversely a general bending plane, a plane 20 for a shoulder 1*a* in FIG. 1 for example, although the plane 20 is shown by a line, which is placed on it, for illustration purpose. The cushioning sheet 5 has a groove 7 formed in its upper surface at the periphery as shown in FIGS. 3 and 5. The cushioning sheet 5 is sewn along the groove 7, so that stitches are received within the groove 7. Thus, the groove 7 provides a good appearance to the cushioning sheet 5 and protects the sewn thread. As illustrated in FIG. 6, the cushioning sheet 5 may be jointed to the garment 1 by heat bonding under pressure with an adhesive and further it may be sewn to it. With such a garment 1, the user may put the protecting pads 2 on by merely wearing the garment, and may be fully protected since the protecting pads 2 are mounted to optimum portions of the garment 1 according to the kind of sport. In use, protecting pads 2 are deformed by bending only cushioning sheets 5 to follow movement of the body of the wearer. This is smoothly performed since the rigid ribs 3 are arranged across respective general bending planes 20. Rigid ribs 3 are subjected to most external impact and protect the garment 1 from being damaged, and cushioning sheet 5 buffer external impact applied to associated rigid ribs 3.

Figure 7:
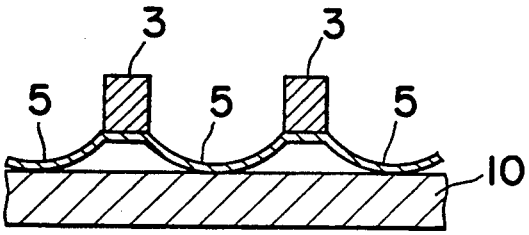
FIG. 7 is a fragmentary cross-section of a modified form of the protecting pad in FIG. 3.

A modified form of the protecting pads 2 of FIGS. 3 and 4 is illustrated in FIG. 7, in which a resilient pad 10 is bonded to the lower face of each cushioning sheet 5. The resilient pad 10 is made of a material, such as a silicone, which does not give any adverse effect on the skin of the wearer. When the cushioning sheet 5 is subjected to excessive external impact, the resilient pad 10 effectively absorbs the impact energy.

Figure 8:
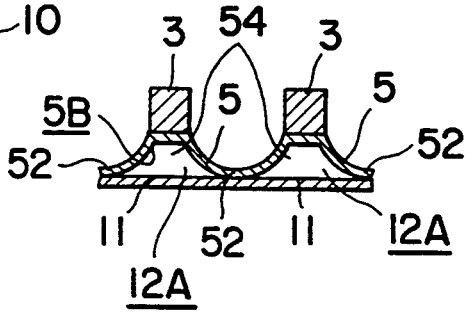
FIG. 8 is a fragmentary cross-section of another modified form of the protecting pad in FIG. 3.
Figure 9:
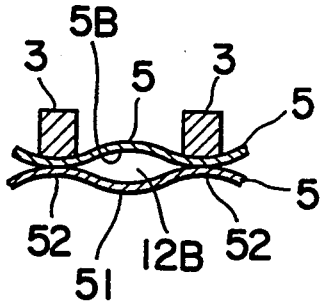
FIG. 9 is a fragmentary cross-section of still another modified form of the protecting pad of FIG. 3.

Still another modified form of the protecting pad 2 in FIGS. 3 and 4 is shown in FIG. 8, in which a resilient sheet 11 is bonded to the inner face 5B of the cushioning sheet 5 at the bottom 52 of the latter to define closed parallel air cushion chambers 12A, 12A, 12A, . . . between the cushioning sheet 5 and the resilient sheet 11. Opposite ends 54, 54 of each air cushion chamber 12A are closed although only one end is shown in FIG. 8. With such air cushion chambers 12A, air in the chambers buffer external impact applied to rigid ribs 3, so that an excellent cushion effect is given to the protector. Another modified form of the protecting pad 2 of FIGS. 3 and 4 is illustrated in FIG. 9, in which another corrugated cushioning sheet 5 is bonded to the inner face 5B of the corrugated cushioning sheet 5, to which rigid ribs 3 are mounted at respective bottoms 52, so that corresponding bottoms 52, 52 of both the cushioning sheets 5, 5 are jointed for defining sealed parallel air cushion chambers by opposingly facing corresponding tops 51 thereof to each other. Also, this modified protecting pad provides an improvement in cushioning effect of the pad in FIGS. 3 and 4.

Figure 10:
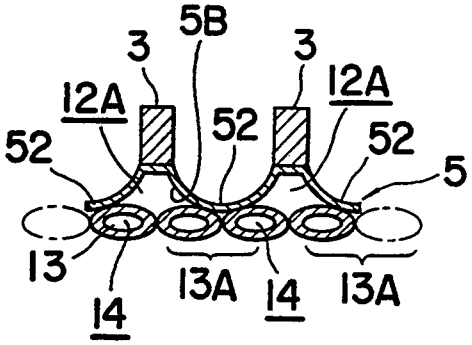
FIG. 10 is a fragmentary cross-section of another modified form of the protecting pad in FIG. 3.

FIG. 10 also illustrates a modified form of the protecting pad in FIGS. 3 and 4. In this modification, adjacent parallel closed air cushion tubes 13, 13, 13, made of a resilient material such as a rubber, are bonded to each other to form pairs of air cushion tubes 13A, 13A, . . . and each pair 13A is bonded to the inner face 5B of a corresponding bottom 52 of the cushioning sheet 5, thereby forming a cushion chamber 12A. The air cushion tubes 13 each define an additional air cushion chamber 14. Thus, in this modified protecting pad there is provided double cushion chambers 12A, 14.

Figure 11:
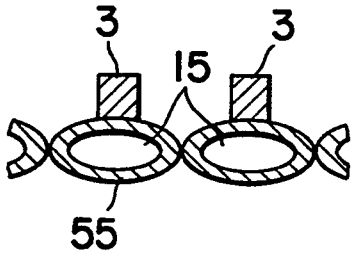
FIG. 11 is a fragmentary cross-section of another embodiment of the present invention.

Another embodiment of the present invention is illustrated in FIG. 11, in which the cushioning sheet 5 of the protecting pad in FIGS. 3 and 4 is replaced by a plurality of parallel closed air cushion tubes 55 bonded to adjacent air cushion tubes 55. Rigid ribs 3, 3 . . . are bonded to tops of respective air cushion tubes 55 to extend along the axes of the latter. In the preceding modified forms of the protecting bad in FIGS. 3 and 4, air in the air cushion chambers 12A, 12B, 14 and 15 buffers external impact applied to rigid ribs 3, 3, . . . , so that excellent cushioning effect is given.

Figure 12:
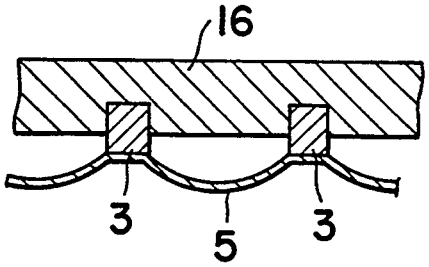
FIG. 12 is a fragmentary cross-section of another modified form of the protecting pad in FIG. 3.
Figure 21:
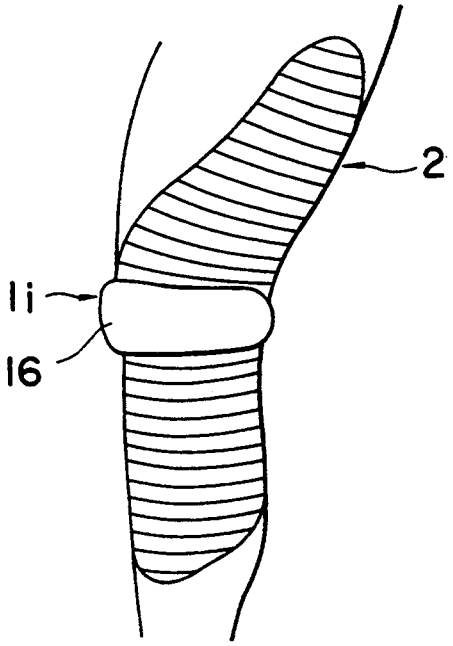
FIG. 21 is a perspective view of a knee protector of the present invention.
Figure 22:
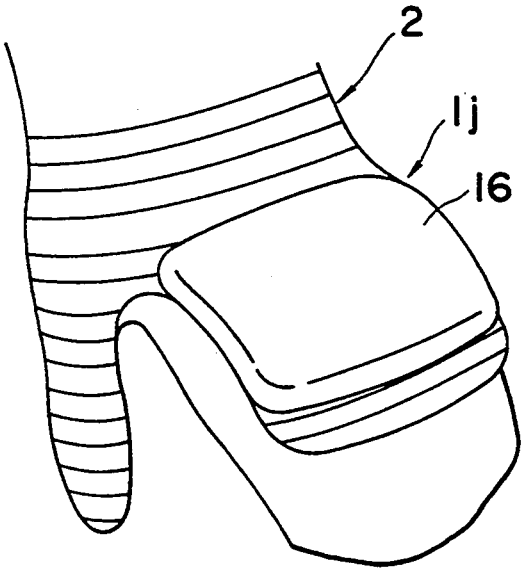
FIG. 22 is a perspective view of a hand phalanges protector according to the present invention.

Another modified form of the protecting pad in FIGS. 3 and 4 is illustrated in FIG. 12, in which a plurality of rigid ribs 3, 3, . . . are jointed at their upper portions by means of a rigid plate member 16 to form a reinforced protecting portion, such as a reinforced chest protecting portion 1*b*'(FIG. 1), a reinforced back protecting pad 1*f*'(FIG. 2), a reinforced knee protecting portion 1*i*'(FIG. 21) or a reinforced hand phalanges protecting portion 1*j*'(FIG. 22). Such reinforced protecting portions provide wide and positive protection to corresponding portions of the body of the wearer which portions have relatively small movements. The rigid plate member 16 may be integrally formed with the rigid ribs 3, 3, . . .

Figure 13:
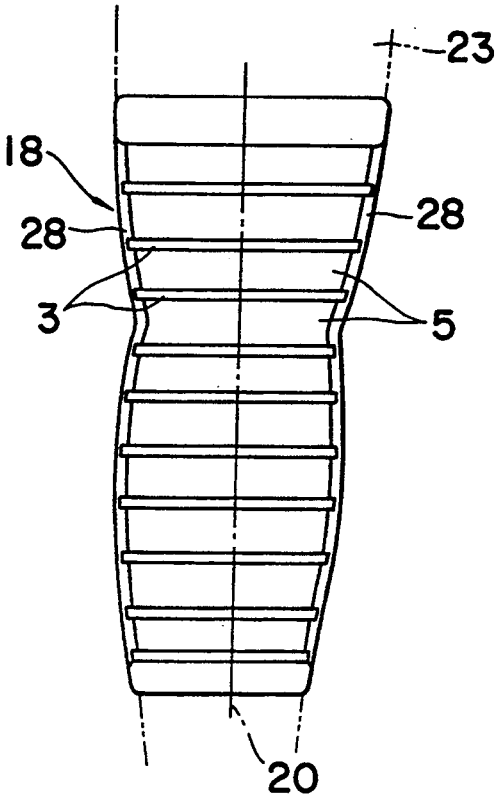
FIG. 13 is a front view of a leg protector using a protecting pad of the present invention.
Figure 14:
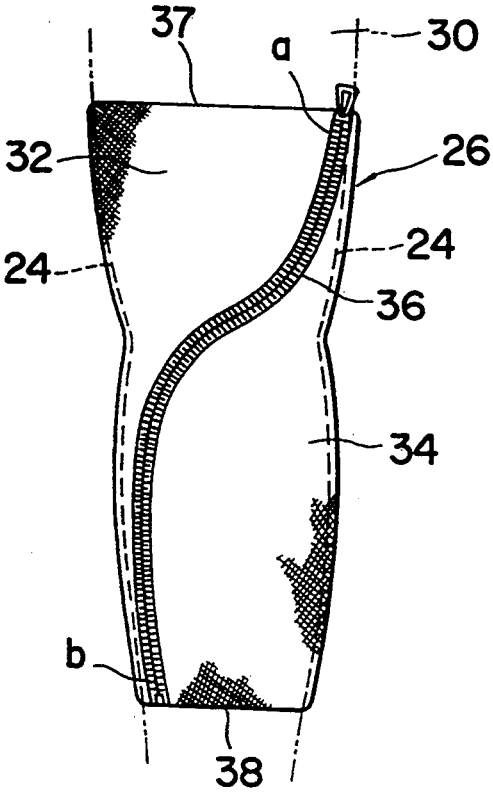
FIG. 14 is a rear view of the leg protector of FIG. 13.

FIGS. 13 and 14 show a leg protector 18 for sport contests such as ski contest. The leg protector 18 includes a plurality of parallel semicircular rigid ribs 3, 3, . . . arranged at equal intervals, and a cushioning sheet 5 on which the rigid ribs 3 are mounted, the cushioning sheet 5 covering the front part 23 of the leg of the wearer. The opposite lateral edges 24, 24 of the cushioning sheet 5 are jointed to corresponding opposite lateral edges 28, 28 of a tightening member 26 for covering the rear part 30 of the leg, thereby forming a tubular protector covering the leg around the knee. The tightening member 26 has an upper part 32 and a lower part 34 and a zipper 36 for connecting these parts 32 and 34, the zipper 36 extending from a position at a right portion of the upper edge 37 of the upper part 32 to a position b at a left portion of the lower edge 38 of the lower part 34. The tightening member 26 is made of an expansible cloth or textile, and preferably made of the latter. As the cloth, those made of spandex thread or rubber core thread may be used. To wear the leg protector, the zipper 36 is opened for separating the upper and lower parts 32, 34, then the protector is placed over the leg around the knee, and finally the zipper 36 is closed. The zipper 36 extend around the calf in a curved manner without extending straight between the two positions a and b, and hence it does not prevent bending and stretching of the leg and provides ease in movement of the leg.

Figure 15:
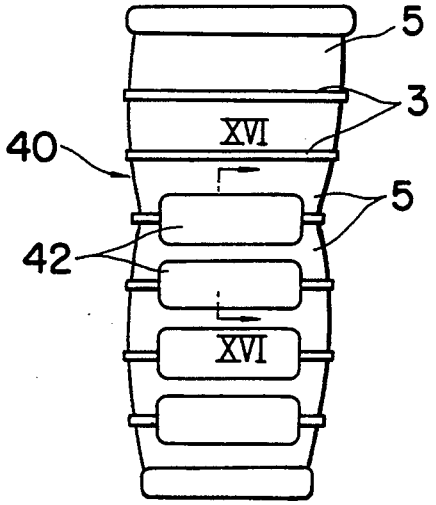
FIG. 15 is a front view of a shinguard using a protecting pad of the present invention.
Figure 16:
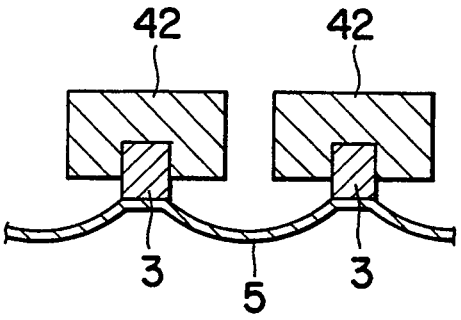
FIG. 16 is an enlarged view taken along the line XVI—XVI in FIG. 15.

FIG. 15 illustrates a shinguard 40 for a catcher of baseball according to the present invention. As in the leg protector in FIG. 13, curved rigid ribs 3 are mounted in parallel to each other on a cushioning sheet 5 which is to cover the shin. A plurality of, four in this embodiment, reinforcing members 42, curved to correspond to respective rigid ribs 3, are mounted to upper portions of the latter. The reinforcing members 42 are substantially equal in strength to the rigid ribs 3. The reinforcing members 42 may be integrally formed With respective rigid ribs 3 or they may be welded to the latter by heating. The shinguard 40 may be provided with the tightening member 26 as in the leg protector in FIG. 14.

Figure 17:
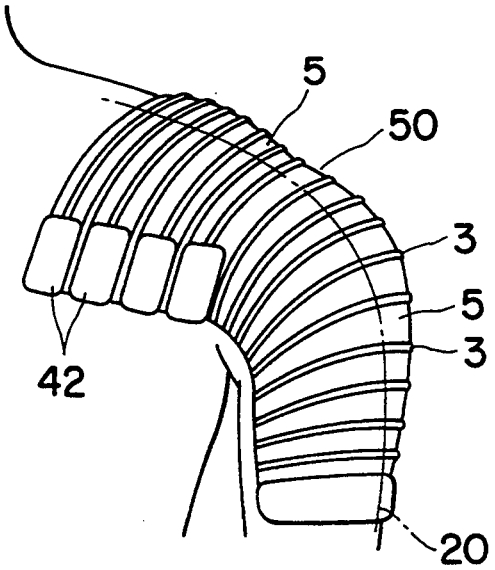
FIG. 17 is a perspective view of a shoulder protector using a protecting pad of the present invention.
Figure 18:
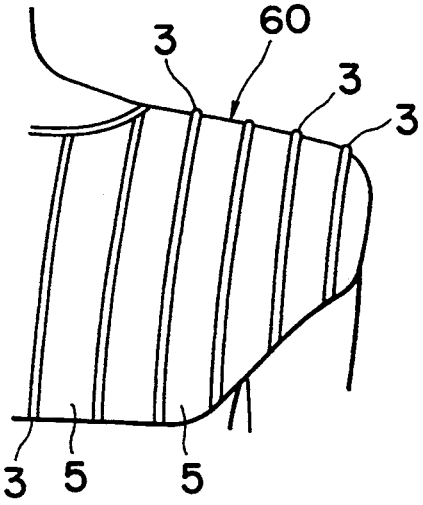
FIG. 18 is a fragmentary front view of a chest protector using a protecting pad of the present invention.
Figure 19:
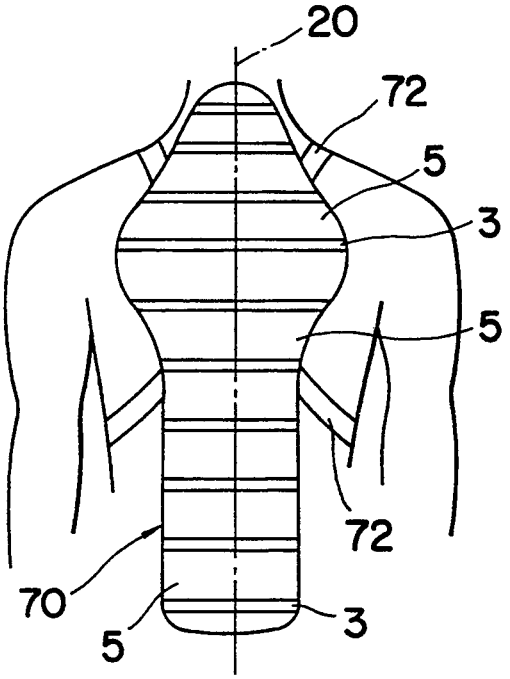
FIG. 19 is a front view of a backbone protector using a protecting pad according to the present invention.
Figure 20:
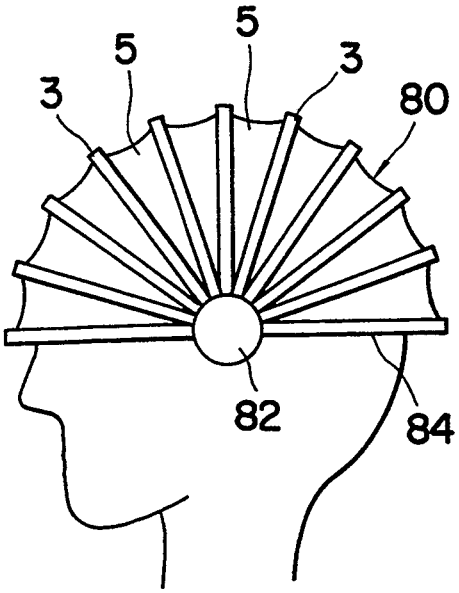
FIG. 20 is a side view of a helmet according to the present invention.

FIGS. 17 to 20 show various protectors according to the present invention: FIG. 17 illustrates a shoulder protector 50 with reinforcing members 42; FIG. 18 a chest protector 60; FIG. 19 a backbone protector 70 which is attached to the wearer by strings 72; and FIG. 20 a helmet 80. In FIGS. 17 and 19, rigid ribs 3 are arranged to be perpendicular to main bending planes 20. The chest protector 60 in FIG. 18 has the rigid ribs 3 arranged vertically along the curve of the chest of the wearer. The helmet 80 in FIG. 20 has a hemispherical cushioning sheet or cup 5 having a pair of terminal discs 82 mounted on its edge 84 symmetrically about the its center although only one terminal disc 82 is shown therein. Eleven rigid ribs 3 which are curved to correspond to the head are mounted on the cushioning cup 5 to extend between the opposite terminal discs 82 at regular angular intervals about the terminal discs 82.

Figure 23:
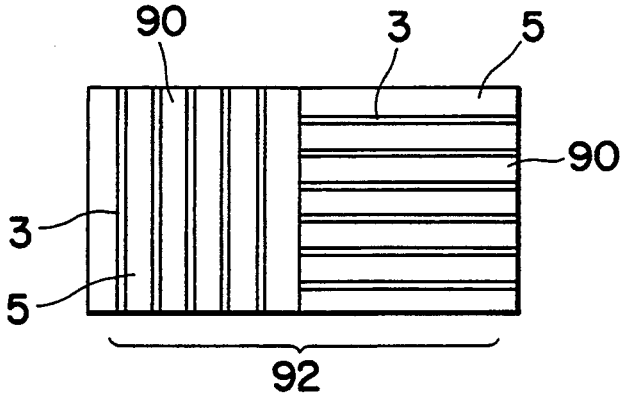
FIG. 23 is a plane view of a protecting pad using two protecting units of the present invention.
Figure 24:
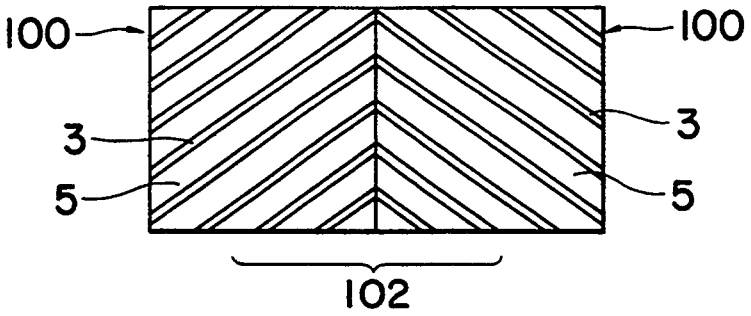
FIG. 24 is a plane view of another protecting pad using two protecting units according to the present invention.
Figure 25:
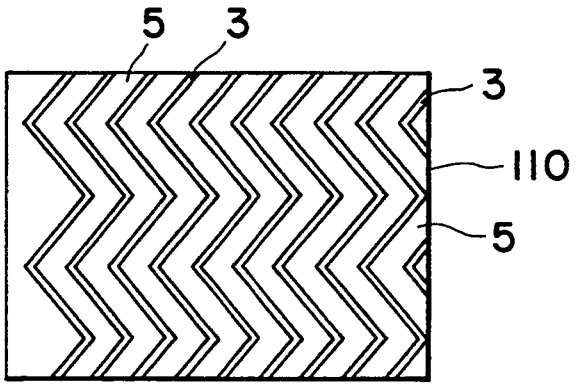
FIG. 25 is a plane view of still another protecting pad, having zigzag rigid ribs, according to the present invention.

FIGS. 23 to 25 illustrate various rectangular protector units which may used in the previous embodiments and modifications.

In FIG. 23, two square protector units 90, 90, each having parallel rigid ribs 3, are jointed at sides of their cushioning sheets 5, 5 to form a united protector pad 92 so that they are perpendicular to each other in the direction of rigid ribs 3.

In FIG. 24, square protector units 100 have diagonally extending rigid ribs 3 and they are jointed to form a united protector pad 102 so that rigid ribs 3 thereof meet at sides of their cushioning sheets 5, 5 at which sides they are united.

FIG. 25 illustrates a rectangular protector unit 110 having rigid ribs 3 being parallel to each other and extending on the cushioning sheet 5 in a zigzagged manner.

What is claimed is:

1. A sports protector comprising:

(a) a cushioning pad for buffering external impact, the cushioning pad having one face being adapted to be mounted over a garment; and (b) a plurality of protecting rigid ribs extending substantially parallel to each other and substantially perpendicular to a main bending plane of part of a body of a wearer for providing ease in movement of the body part, wherein the movement of the body part mainly occurs along the main bending plane, the rigid ribs being of sufficient rigidity to permit substantial deformation of the pad, in use as a sports protector, only by bending at the main bending plane, said rigid ribs being mounted on the other face of the cushioning pad for protecting the cushioning pad from being damaged by the external impact, wherein the cushioning pad has a corrugated shape, having parallel top portions and bottom portions, and further comprises a cushioning lining which has a plurality of parallel closed tubes, adjacent tubes being attached to each other for defining air cushion chambers therein, the cushioning lining being attached to the bottom portions of the cushioning pad for cushioning the external impact applied to the cushioning pad, the rigid ribs being mounted on respective top portions of the cushioning pad, the cushioning lining being sealingly attached to the cushioning pad to define additional air cushion chambers for buffering the external impact applied to the cushioning pad.

2. A sports protector comprising:

(a) a cushioning pad for buffering external impact, the cushioning pad having one face being adapted to be mounted over a garment;

(b) a plurality of substantially parallel protecting rigid means, mounted on the other face of the cushioning pad in a spaced manner, for protecting the cushioning pad from being damaged from the external impact, wherein the rigid means comprises rigid ribs extending substantially parallel to each other, the rigid ribs extending substantially perpendicularly to a main bending plane of part of a body of a wearer for providing ease in movement of the body part, wherein the movement of the body part mainly occurs along the main bending plane, the rigid ribs being of sufficient rigidity to permit substantial deformation of the pad, in use as a sports protector, only by bending at the main bending plane, and the cushioning pad has a corrugated shape, having parallel top portions and bottom portions;

(c) a cushioning lining, attached to the one face of the cushioning pad, for cushioning the external impact applied to the cushioning pad, wherein the rigid ribs are mounted on respective top portions of the cushioning pad, the cushioning lining is attached to the bottom portions of the cushioning pad, the cushioning lining is sealingly attached to the cushioning pad to define air cushion chambers for buffering the external impact applied to the cushioning pad and the cushioning lining comprises a plurality of parallel closed tubes for defining additional air cushion chambers therein, adjacent tubes being attached to each other.

* * * * *